US011642266B2

(12) United States Patent
Raymond et al.

(10) Patent No.: US 11,642,266 B2
(45) Date of Patent: May 9, 2023

(54) PATIENT SUPPORT APPARATUS WITH MAGNETORHEOLOGICAL MATERIAL

(71) Applicant: Stryker Corporation, Kalamazoo, MI (US)

(72) Inventors: Justin Raymond, Jackson, MI (US); Patrick Lafleche, Kalamazoo, MI (US); Kevin Patmore, Plainwell, MI (US)

(73) Assignee: Stryker Corporation, Kalamazoo, MI (US)

( * ) Notice: Subject to any disclaimer, the term of this patent is extended or adjusted under 35 U.S.C. 154(b) by 172 days.

(21) Appl. No.: 17/005,603

(22) Filed: Aug. 28, 2020

(65) Prior Publication Data

US 2021/0059881 A1 Mar. 4, 2021

Related U.S. Application Data

(60) Provisional application No. 62/892,923, filed on Aug. 28, 2019.

(51) Int. Cl.
*A61G 7/057* (2006.01)
*A47C 27/16* (2006.01)
(Continued)

(52) U.S. Cl.
CPC ..... *A61G 7/05746* (2013.01); *A47C 27/082* (2013.01); *A47C 27/083* (2013.01);
(Continued)

(58) Field of Classification Search
CPC ..... A61G 7/05723; A61G 7/05746; A61G 2203/34; A61G 2203/70; A61G 7/05715;
(Continued)

(56) References Cited

U.S. PATENT DOCUMENTS 4,596,250 A 6/1986 Beisang, III et al.
5,749,111 A * 5/1998 Pearce ..... B29C 48/11 428/137
(Continued)

FOREIGN PATENT DOCUMENTS

CN 102599760 B * 3/2015 ..... A47C 27/00
CN 106361044 A * 2/2017 ..... A47C 17/86
(Continued)

*Primary Examiner* — David R Hare
*Assistant Examiner* — Madison Emanski
(74) *Attorney, Agent, or Firm* — Howard & Howard Attorneys PLC

(57) ABSTRACT

A patient support apparatus is provided with selective stiffening features. The patient support apparatus may include a support substrate defining a patient support surface. The support substrate may include a magnetorheological material providing selective reinforcement support of at least a portion of the patient support surface to redistribute pressure about a surface of a patient. The magnetorheological material may include a distribution of ferromagnetic particles disposed within a polymeric material and exhibits a shape conforming, variable stiffness in response to exposure to a magnetic field. A controller may be provided and configured to create a correlation of patient specific data with an optimal stiffness or inflection force deflection (IFD) of the patient support surface, and generate a strength of the magnetic field based on the correlation.

14 Claims, 9 Drawing Sheets

(51) Int. Cl.
*A47C 27/08* (2006.01)
*A47C 27/14* (2006.01)
*A47C 27/15* (2006.01)

(52) U.S. Cl.
CPC ..... *A47C 27/142* (2013.01); *A47C 27/148* (2013.01); *A47C 27/15* (2013.01); *A47C 27/16* (2013.01); *A61G 7/05723* (2013.01); *A61G 2203/34* (2013.01); *A61G 2203/70* (2013.01)

(58) Field of Classification Search
CPC ..... A61G 7/05769; A47C 27/142; A47C 27/146; A47C 27/15; A47C 27/16; A47C 27/20; A47C 27/0456; A47C 27/00; A47C 27/082; A47C 27/083; A47C 31/003; A47C 27/144; A47C 7/027; A47C 23/0433; A47C 23/0435; A47C 27/061; Y10S 5/948; Y10S 5/906
See application file for complete search history.

(56) References Cited

U.S. PATENT DOCUMENTS

| | | | |
|---|---|---|---|
| 6,755,852 | B2 | 6/2004 | Lachenbruch et al. |
| 2007/0073368 | A1 | 3/2007 | Cazzini et al. |
| 2016/0346115 | A1 | 12/2016 | Varga et al. |

FOREIGN PATENT DOCUMENTS

| | | | | | |
|---|---|---|---|---|---|
| KR | 200203740 | Y1 | * | 11/2000 | ..... A61N 2/06 |
| KR | 20140048521 | A | * | 4/2014 | ..... A61G 7/05715 |
| KR | 20200040825 | A | * | 8/2018 | ..... A47C 27/15 |

* cited by examiner

PATIENT SUPPORT APPARATUS WITH MAGNETORHEOLOGICAL MATERIAL

CROSS-REFERENCE TO RELATED APPLICATION

The present application claims priority to U.S. Provisional Patent Application Ser. No. 62/892,923, filed Aug. 28, 2019, which is incorporated herein by reference in its entirety.

BACKGROUND

The present disclosure relates to patient support apparatuses, such as beds, cots, stretchers, operating tables, recliners, wheelchairs, and the like. More specifically, the present disclosure relates to a redistribution of pressure from the support structures and support substrates within the patient support apparatus, such as a patient mattress or components thereof, which ultimately provide a patient support surface.

When patients are hospitalized or bedridden for any significant amount of time, patients can develop pressure sores or ulcers. Pressure sores or ulcers typically form as a result of prolonged immobility, which allows the pressure exerted on the patient's skin from the mattress to decrease circulation in the patient's tissue. These pressure sores or ulcers can be exacerbated by the patient's own poor circulation, such as in the case of diabetic patients. In addition to reducing circulation in the patients' tissue, lack of mobility can also cause moisture build-up at the point of contact with the mattress. Moisture build-up can cause maceration in the skin, which makes the skin more permeable and vulnerable to irritants and stresses, such as stresses caused by pressure or by shear, for example, when a patient is moved across a mattress.

To reduce the chance of developing pressure ulcers, it is known to try and redistribute the pressure, for example, by repositioning a patient so that the pressure is redistributed to another portion of the patient's body. However, in certain instances, repositioning may not be possible or does not adequately address the patient's medical needs.

While different patient support apparatuses are available in various sizes and shapes, configured to support patients of various weights and personal attributes, the support structures that ultimately provide a non-powered patient support surface can only be designed and optimized for a pressure distribution around a specific patient weight. Typically, the support structures are optimized for a median patient weight, based on population. As such, this reduces performance at far ends of the spectrum for lighter or heavier patients within that population.

Accordingly there is a need for a mattress that can reduce the pressure on a patient's skin that is not limited in design to a median weight patient, and further that can maintain or improve air circulation to the patient's skin, all in an attempt to improve the care of the patient.

BRIEF DESCRIPTION OF THE DRAWINGS

The present teachings will become more fully understood from the detailed description and the accompanying drawings, wherein.

It should be noted that the figures set forth herein are intended to exemplify the general characteristics of the systems, methods, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures, while other aspects may incorporate only portions of features from a single figure.

DETAILED DESCRIPTION

The present technology generally provides an enhanced patient support apparatus with strategic stiffening features, as well as integral thermal management and airflow features, in order to deliver enhanced patient care and reduce the development of pressure sores, ulcers, and the like. In order to afford a more tailored stiffness of a patient support surface, the present technology uses one or more magnetorheological materials disposed in a patient support/mattress or another support component thereof, such as a foam component, a support substrate, a cushion, and the like. When an electrical current or a magnetic field is applied or energized adjacent the magnetorheological material, the magnetic particles disposed within the magnetorheological material realign and ultimately change the stiffness in the patient support, support substrate, or cushion or support component. In various aspects, the stiffness or rigidity can be manipulated by the amount and type of magnetorheological materials present, the structure of the magnetorheological materials, as well as the intensity of the electrical current or magnetic field that is applied or energized. For example, as the intensity increases, the patient support surface becomes more rigid, which affects the indentation force deflection (IFD) of at least a portion of the patient support.

In various aspects, as will be detailed below, correlations can be made between the applied current or magnetic field, and an optimized mattress stiffness for a given patient, thereby providing an optimal pressure redistribution that can be adjusted in real time. For example, a care giver can enter (or otherwise obtain) certain patient data, such as height, weight, age, mobility issues, tissue interface pressure (TIP) data, and/or various other medical data, and the present technology can determine an optimum buckling load of the patient support, or portion thereof, and manipulate a magnetorheological material in order to adjust a stiffness of one or more regions prior to the patient being placed on the patient support apparatus. It is also envisioned that one or more stiffness features may be monitored and changed/corrected as needed after the patient is placed onto the mattress.

Figure 1:
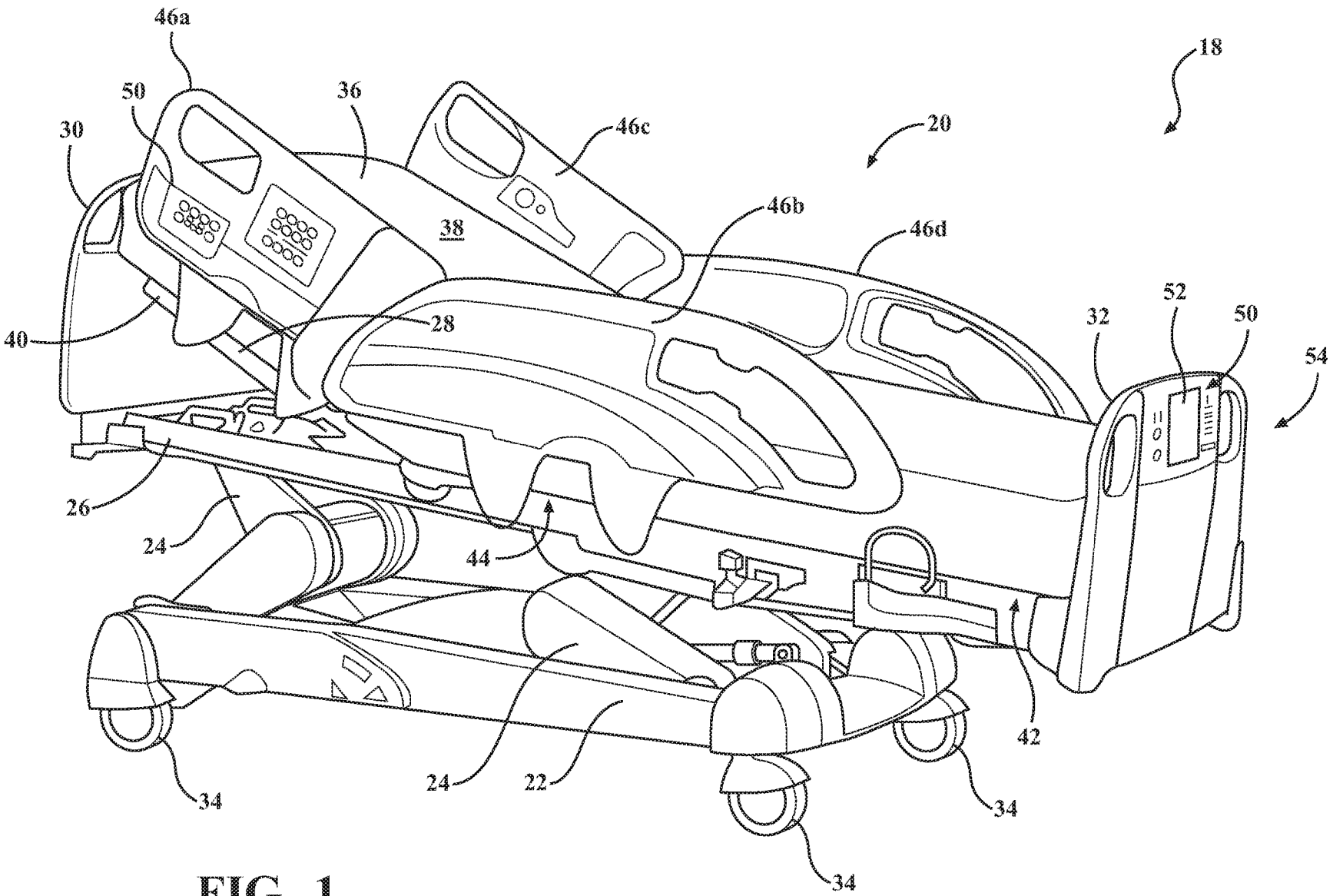
FIG. 1 is a top-side perspective view of an exemplary patient support apparatus provided as a gatch-type hospital bed.

For a more complete understanding of the present teachings, reference is made to FIG. 1, illustrating one example of a patient support apparatus 18 with an adjustable frame that is configured as a bed 20 and generally adapted for use in a hospital or other medical setting. FIG. 1 is a top-side perspective view of an exemplary bed 20 with a raised head section. Although the particular form of the patient support apparatus illustrated in FIG. 1 is a bed, it should be understood that patient support apparatuses useful with the present technology may also include, in different embodiments, stretchers; gurneys; cots; trolleys; operating tables; benches; wheelchairs, as well as traditional chairs, seats, and recliners; or any other similar type of structure capable of supporting a patient, whether stationary or mobile and/or whether used for medical or residential environments. In still other aspects, the patient support apparatus may be configured to change in shape and function, for example, between a stretcher or bed and a chair.

The exemplary gatch-type hospital bed 20 as shown in FIG. 1 includes a base 22, an automated drive system such as a pair of lifts 24, an adjustable frame commonly referred to as a litter assembly 26, a patient support deck 28, a headboard 30, and a footboard 32. The base 22 includes a plurality of wheels 34 that can be selectively locked and unlocked so that, when unlocked, the patient support apparatus 18 is able to be wheeled to different locations. Certain of the wheels 34 may be steering type wheels, with castors or otherwise configured to rotate up to 360 degrees, other wheels may not be rotatable. The base 22 may include one or more retractable wheels (not shown) to provide controlled traction and cornering. The base 22 may also include one or more powered wheels, the movement of which can be operated by a controller. Certain wheels 34 may be provided with locking mechanisms (not specifically shown). The lifts 24 are generally configured to raise and lower the litter assembly 26 with respect to the base 22. In this regard, the lifts 24 may include hydraulic actuators, electric actuators, or any other suitable device for raising and lowering the litter assembly 26 with respect to the base 22. In some embodiments, the lifts 24 may operate independently so that the orientation of litter assembly 26 with respect to the base 22 may also be adjusted. The lifts 24 may be of various designs; certain lifts 24 are configured to raise and lower extending legs or columns in a substantially vertical direction, while others include hinges or scissor type lift mechanisms having linked, folding supports in a crisscross or 'X' pattern.

The litter assembly 26 of the bed 20 of FIG. 1 provides a structure for coupling with the supporting deck 28, a headboard 30, and a footboard 32. The supporting deck 28 provides a surface on which a patient support, such as mattress 36, or other support member, is positioned defining a patient support surface 38 where a patient may lie and/or sit thereon. The deck 28 may be made of a plurality of sections, some of which are pivotable about generally horizontal pivot axes. In the embodiment shown in FIG. 1, the deck 28 includes a head section 40, a foot section 42, and one or more intermediate sections 44. The head section 40, which is also sometimes referred to as a fowler section, is pivotable with respect to the intermediate section 44 between a generally horizontal orientation and a plurality of raised positions (one of which is shown in FIG. 1). The foot section 42, which is also sometimes referred to as a gatch section, is also pivotable with respect to the intermediate section 44 between a generally horizontal orientation (shown in FIG. 1) and a plurality of lowered positions (not shown). In certain aspects, the head section 40 may be lowered, and the foot section 42 may be raised or elevated, with respect to the intermediate section 44, for example to increase blood flow to the upper body. The base 22, the lifts 24, the litter assembly 26, the support deck 28 and its various sections 40, 42, 44, as well as other movable components, may each be provided with the necessary mechanical structures, actuators, automated drive mechanisms, etc. for exhibiting independent and automated movement, control, and related capabilities of the patient support apparatuses 18.

The various patient support apparatuses 18 may also include a plurality of side rails, collectively referred to by reference number 46. For example, the bed of FIG. 1 includes a right head side rail 46*a*, a right foot side rail 46*b*, a left head side rail 46*c*, and a left foot side rail 46*d*. The side rails 46 are generally movable between a raised position and a lowered position, and in various aspects can be locked or provided at intermediate positions. The side rails 46 can be provided with handle areas for use by the patient or caregiver. In the configuration shown in FIG. 1, all four of the side rails 46 are raised. As shown in FIG. 1, the interior side of the head side rails 46*a*, 46*c* may be provided with a patient control interface 48 configured to operate movement of the head section 40 and foot section 42, as well as control other auxiliary features, such as lights, televisions, sound control, and the like. The exterior side of the head side rails 46*a*, 46*c* may be provided with a caregiver control interface 50, similarly configured to operate movement of the bed 20, as well as other functions.

As shown in FIG. 1, the footboard 32 may also be provided with one or more caregiver control interface 50 and/or display 52 with optional touchscreen capabilities. In certain aspects, the footboard 32 may include a controller 54 that includes the caregiver control interface 50 and display 52. The controller 54 may include at least one processor with memory and software programmable to control various aspects of the bed 20. The teachings of the present technology may be used with known control systems and may generally include a computing device or controller 54, such as a control module with a processor, a memory, and an interface 50. It should be understood that although particular systems or subsystems may be separately defined herein, each or any of the systems may be otherwise modified, combined, or segregated via appropriate hardware and/or software as is known to those of ordinary skill in the art. For example, the controller 54 may be a portion of another control device, a stand-alone unit, or other system, including cloud based. Alternatively, the controller 54 can be composed of multiple computing devices. The processor(s) may be any type of conventional microprocessor having desired performance characteristics and capable of manipulating or processing data and other information. The memory may include any type of computer readable medium that stores data and control algorithms described in more detail below. Other operational software for the processor may also be stored in the memory. The interface may facilitate communication with other systems, sensors, and other on-board systems. On-board systems and sensors may include, but are not limited to, weight sensors, diagnostic sensors, auxiliary systems and accessories, automated controls, and the like. The controller 54 can also include secondary, additional, or external storage, for example, a memory card, flash drive, or any other form of computer readable medium. Installed applications can be stored in whole or in part in the external storage and loaded into the memory as needed for processing.

In various aspects, the controller 54 may be located out of view, for example, secured in the base 22 or coupled to the litter assembly 26, as appropriate. The controller 54 may alternatively be an external unit that is wired to the bed 20 or communicates via wireless communication. Thus, the bed 20 may also be provided with one or more communication module configured to establish a wireless communication. Various wireless communication protocols may be used, including Bluetooth, near-field communication (NFC), infrared communication, radio wave communication, cellular network communication, and wireless local area network communication (Wi-Fi). In certain aspects, the communication module may be a part of the controller 54. The wireless communication may provide compatibility with information management systems. Not only can the patient support apparatuses 18 be coupled to the controller 54 using wireless communication protocols, one or more patient support apparatuses 18 can establish a communication link directly or indirectly with one another in order to share data, information, and exhibit control.

Figure 2:
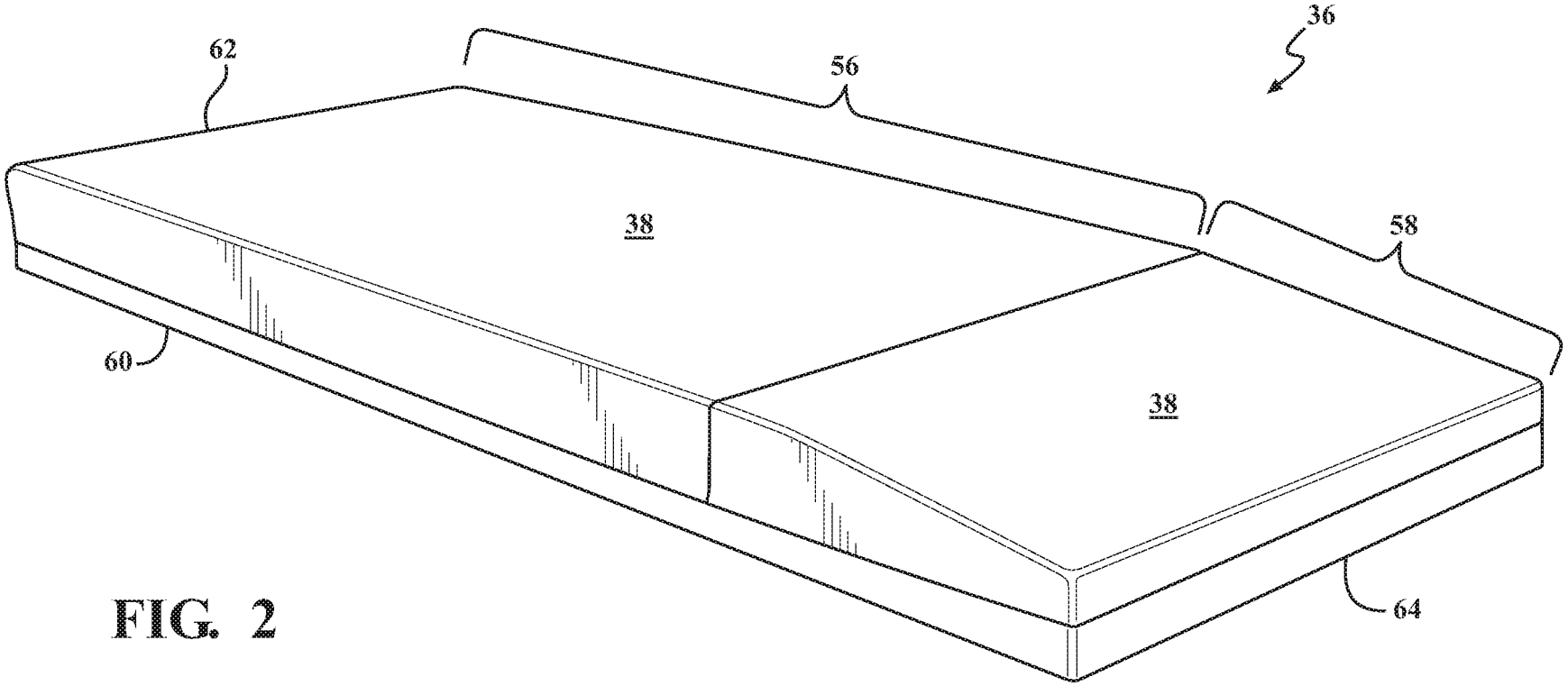
FIG. 2 is a top-side perspective view of an exemplary patient support provided as a mattress useful with the hospital bed of FIG. 1.

FIG. 2 is a top-side perspective view of an exemplary patient support 36, such as a mattress, which ultimately defines a patient support surface 38. As specifically shown, the patient support 36 can be described as having two main portions, a substantially horizontal portion 56 for receiving an upper body region of the patient, and an optional sloped heel portion 58 for receiving the lower leg and foot region of the of the patient, and to minimize heel breakdown. In other aspects, the two portions 56, 58 may both be provided as substantially horizontal across a length and width of the patient support 36. The patient support can include a removable, protective cover 60 extending between opposing head and foot ends 62, 64 and across the width of the patient support 36. In various aspects, the upper portion of the cover 60 that ultimately forms the contact surface of the patient support surface 38 may include at least a portion that is a breathable mesh material, configured to selectively allow a controlled airflow from within an interior of the patient support 36 and up between the patient support surface 38 and a patient's skin. The protective cover may also be a woven material, a flexible fabric, a plastic, or other suitable material that may be easily cleaned and sterilized and for preventing exposure of the remaining interior of the patient support 36 to an external environment.

Figure 3:
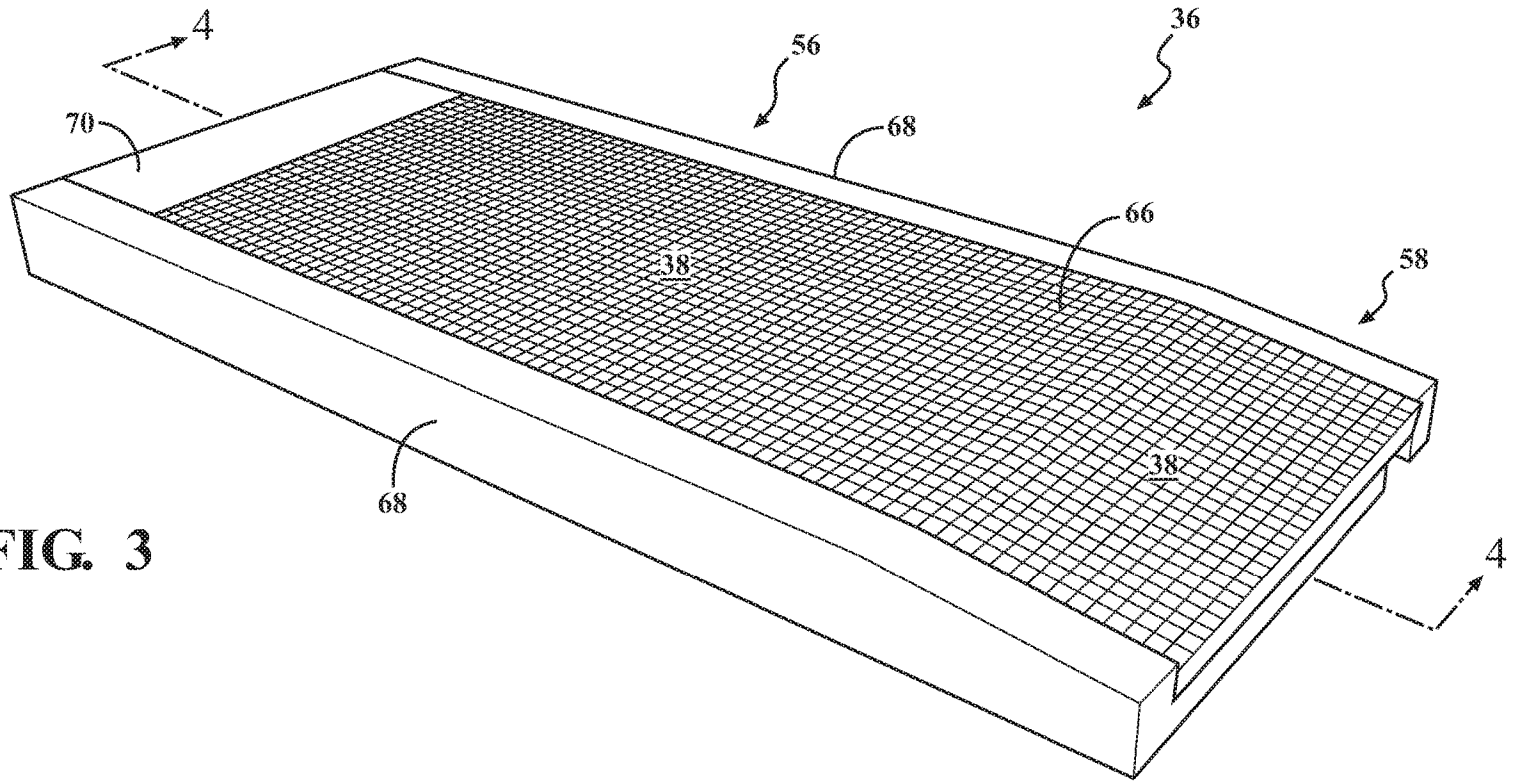
FIG. 3 is a top-side perspective view of the exemplary patient support of FIG. 2 without a protective cover according to a first aspect.
Figure 4:
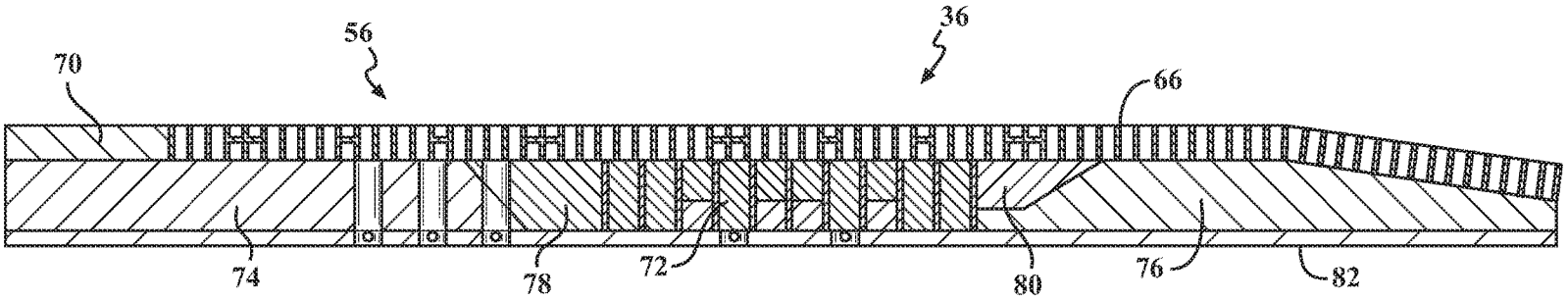
FIG. 4 is a cross-sectional view of the exemplary patient support taken along the line 4-4 of FIG. 3.

FIG. 3 is a top-side perspective view of the exemplary patient support 36 of FIG. 2 shown without a protective cover according to a first aspect. FIG. 4 is a cross-sectional view of the exemplary patient support 36 taken along the line 4-4 of FIG. 3. As illustrated, the patient support 36 may include a number of different support components and support substrates.

For example, the patient support 36 may include various layers with different cushioning components and support substrate components that, in combination, assist with managing pressure redistribution while achieving optimal comfort for the patient. An uppermost layer may include an upper section of a support substrate 66 surrounded on three sides by a U-shaped section of foam, which may include opposing foam side bolsters 68 and a front or head bolster 70. The upper support substrate 66 generally extends from the head bolster 70 to the foot end 64 of the patient support 36. The foam side bolsters 68 flank the upper support substrate 66 and provide stability to the upper support substrate 66. In various aspects, the foam side bolsters 68 are attached to the upper support substrate 66. They further provide a firm edge for the support substrate 66 to ease ingress and egress for a patient. In addition, because of the firmness difference between the upper support substrate 66 and the foam bolsters 68, 70, the upper support substrate 66 may tend to compress more than the foam bolsters 68, 70, so that the foam bolsters 68, 70 form a barrier to cradle the patient in the support, which reduces the chances of a patient falling off the bed 20 on which the patient support 36 is ultimately supported. Optionally, the foam bolsters 68, 70 may be taller than the upper support substrate 66 to form an even taller barrier. The upper support substrate 66 may also include flanges (not shown) that extend along its length and/or width, which are formed from a fabric and are adhered to the foam side bolsters 68 and sandwiched there between to anchor the upper support substrate.

With reference to FIG. 4, the patient support 36 may include a middle layer that includes a center support substrate 72 disposed between a head area cushion 74 and a leg area cushion 76. The center support substrate 72 is located to further assist and redistribute pressure in the sacral region and reduce return force. For example, the center support substrate 72 can isolate pressure in the sacral region by selectively buckling and absorbing the patient's weight, allowing immersion and envelopment to take place, resulting in optimal comfort. Additional cushions may also be provided, for example, in the central or torso area 78 and the thigh area 80 that have a greater density, as well as provide a higher indentation force deflection than adjacent foam or cushions. A lower foam or cushion base layer 82 may be provided adjacent the middle layer.

In various aspects, an air distribution bladder may optionally be included (not specifically shown) located on top of, adjacent to, and/or anchored to a base layer 82 or similar component. For example, one or both ends of the air distribution bladder may be anchored, such as by welding or by an adhesive, to the base layer 82. In other aspects, an air distribution bladder may be located between the support substrate components 66, 72. The air distribution bladder may be filled with air using an external air supply 84 (see, FIG. 14) or an air supply built into the patient support 36. For example, the air distribution bladder may include one or more inlets that couple to tubing that extends from the bladder to beneath foam base layer to connect to an air flow device, such as pump or a fan, which is then regulated by a conventional control. The pump and any supporting control system may be mounted in the support itself, such as described in U.S. Pat. Nos. 5,325,551, and 5,542,136, both commonly owned by Stryker Corporation of Kalamazoo, Mich., or may be located external to the support, for example at the footboard or the side rail, or at other locations on or off the bed. Air may be pushed or pulled through the bladder. Further, the air flow may be bidirectional. As is understood, pulling air meets with less resistance than pushing air, so pulling air may be preferred in order to reduce the size of the air flow device. The air may be cooled air, ambient air, or warmed air. In one example, a Peltier device, which can provide cold or warm air, may be incorporated into the air supply system to allow the air to be cooled or warmed as desired.

Figure 5:
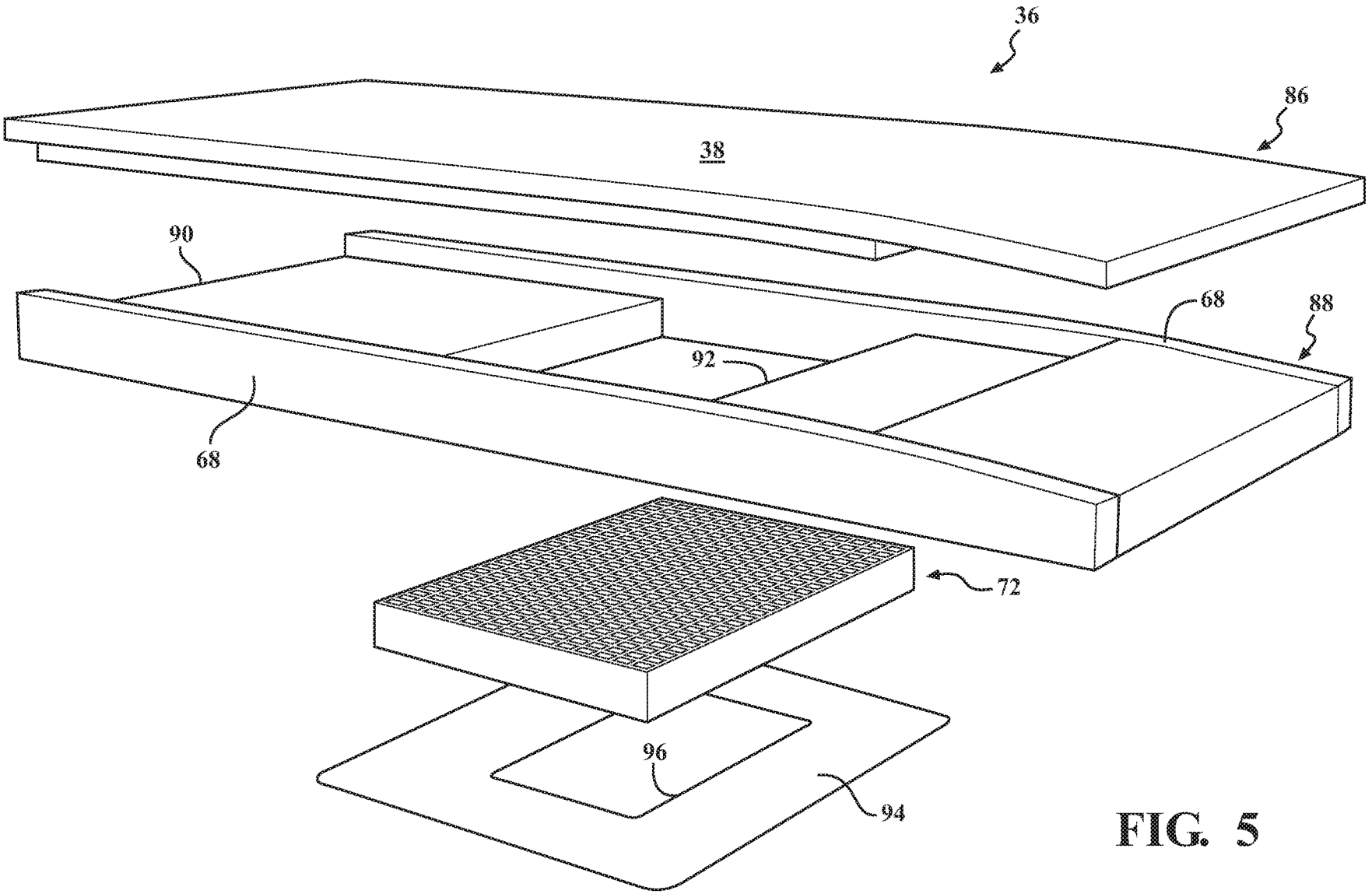
FIG. 5 is a exploded top-side perspective view of an exemplary patient support of FIG. 2 without a protective cover according to a second aspect.

FIG. 5 is a top-side perspective exploded view of an exemplary patient support 36 of FIG. 2 (without a protective cover) according to a second aspect. Similar to the patient support 36 of FIG. 2, the patient support 36 configuration of FIG. 5 also provides a patient support surface 38 designed to redistribute pressure in the vulnerable sacral region, to help prevent pressure sores or ulcers, and provide optimal comfort for a superior patient experience. As shown, the patient support 36 includes an upper layer 86, and a lower layer 88. The upper layer 86 may extend substantially across the entirety of the patient support 36. The lower layer 88 may include opposing side bolsters 68, as well as an upper body cushion 90 and lower body cushion 92. A center support substrate 72 may be specifically located to assist and redistribute pressure in the sacral region and reduce return force, similar to the aspect shown in FIG. 2. The combination of cushions and support substrates shown in FIG. 5 may be designed and shaped to create a positioning pocket that helps prevent the patient from migrating to the foot end of the bed when the head of the bed is elevated. A center base layer 94 may be provided defining an aperture 96 to allow airflow between the external environment, through the center support substrate 72, and ultimately to the patient support surface 38. This type of airflow can be accomplished without the use of an external air circulation pump, and without any valves or air bladders, minimizing the use of additional mechanical components.

Figure 7:
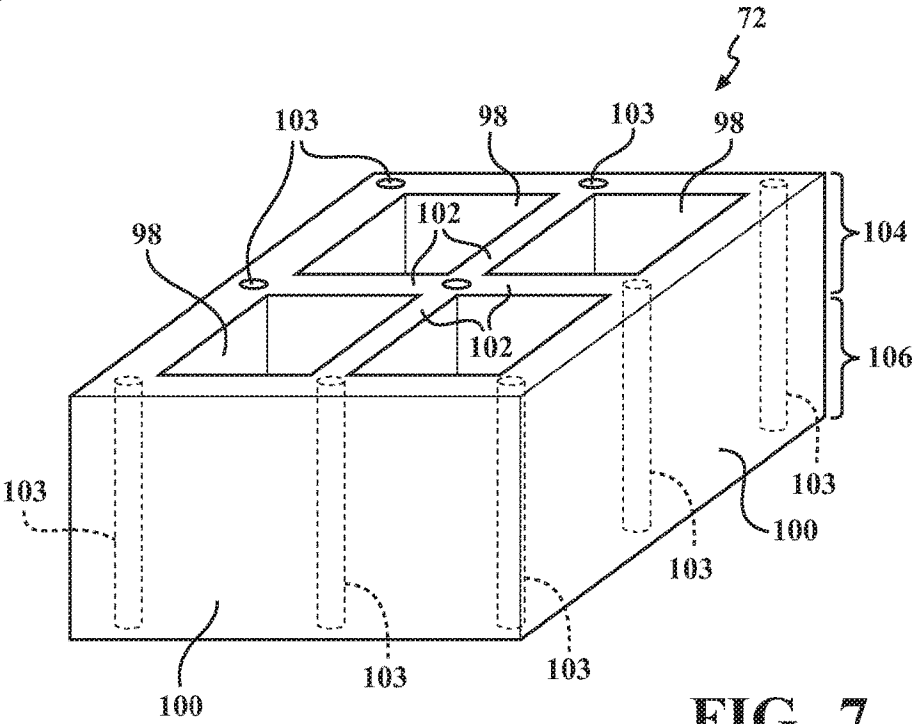
FIG. 7 is a magnified perspective view of a portion of the support substrate component of FIG. 6.
Figure 6:
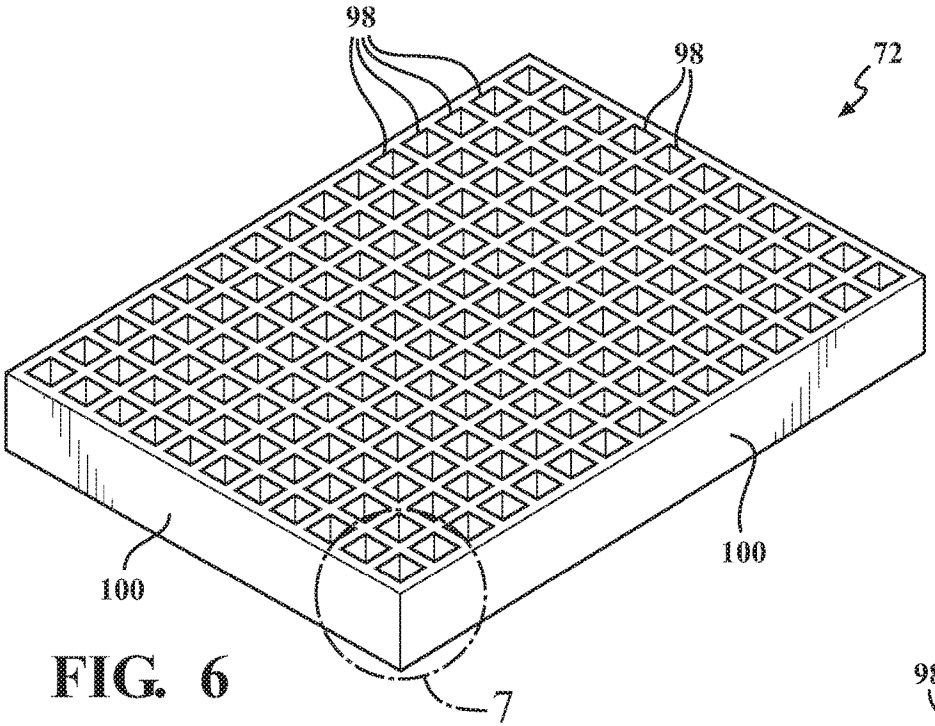
FIG. 6 is a top-side perspective view of an exemplary support substrate component of the patient support of FIGS. 2 and 5 including a plurality of transversely extending cells.

FIG. 6 is a top-side perspective view of an exemplary center support substrate 72 component of the patient support 36 of FIGS. 2 and 5. FIG. 7 is a magnified perspective view of a corner portion of the center support substrate 72 component of FIG. 6. Although labeled as the center support substrate 72, the discussion of FIGS. 6 and 7 is equally applicable to the upper support substrate 66 of FIGS. 3-4. Still further, it should be understood that while only center and upper support substrates 66, 72 are shown in the figures, the patient support 36 may include various additional or alternative support substrates located therein. As will be described in more detail below, the upper and center support substrates 66, 72 may be formed as a lattice structure with a plurality of polygonal cells 98 with transverse openings that may be in fluid communication with the other respective layers of the patient support 36 to permit air flow to the interface between the patient and the patient support 36, for example, at or near the patient support surface 38 of the upper support substrate 66. The outer edges of the support substrates 66, 72 may include linear or shaped side walls 100, depending on the shape of the polygonal cells 98. For example, as shown in FIGS. 3-7 and FIGS. 12-13, the polygonal cells 98 are shown as square shaped cells with four walls disposed with an interior angle of about 90 degrees with respect to one another. As shown in FIGS. 8-11, the polygonal cells 98 are shown as hexagonal shaped cells 98 with six walls disposed with an interior angle of about 120 degrees with respect to one another.

The present technology provides that one or more components of a patient support apparatus 18 include a magnetorheological material that can be configured to provide a selective reinforcement support of at least a portion of a patient support 36 and/or patient support surface 38 in order to redistribute pressure about a surface of a patient. In various aspects, each of the internal components of the patient support 36, such as cushions, foam pieces, and the support substrates may play a role to ultimately define or influence, in part or in whole, an overall stiffness of the patient support 36, including at the patient support surface 38. As such, it is envisioned that any one or all of the various components of the patient support 36 may include a magnetorheological material. For purposes of simplicity only, the following discussion will focus on the inclusion of magnetorheological materials present in the upper and center support substrates 66, 72. It should be understood, however, that the magnetorheological materials may additionally or alternatively be present in any number of the components of the patient support 36.

In broad terms, non-limiting, shape conforming magnetorheological materials, as described in more detail below, may include magnetorheological fluids, magnetorheological elastomers, and magnetorheological foams. The magnetorheological material may include a distribution of ferromagnetic particles disposed therein that, upon being subjected to a magnetic field, rapidly alter their rheological properties. The movement of micron-sized ferrous particles dispersed in the magnetorheological materials and may exhibit a sharp variation in the stiffness of the magnetorheological material, capable of conforming it to a shape or adding increased rigidity to control its compression. In various aspects, the magnetic field can be introduced using an electric current or a suitable magnet, such as an electromagnet.

Magnetic fields are flux forces that generally arise due to the movement of an electrical charge. The movement of electrical charge may occur via the movement of electrons in an electric current, known as electromagnetism, or via the quantum-mechanical spin and orbital motion of electrons in an atom. For example, a wire that has an electrical current running through it creates a magnetic field. Thus, in various aspects of the present technology, the support substrate 66, 72 may be provided with electrically conductive wires and/or a circuit disposed throughout at least one region. An electrically conductive circuit may be configured to selectively generate the magnetic field which, in turn, increases the stiffness of localized areas or an entirety of the support substrate 66, 72. In still other aspects, one or more magnets can be provided to create the magnetic field. In various aspects, the magnet may be an electromagnet, a permanent magnet, or a combination of both.

Where the magnetorheological medium is a fluid, it may be configured to selectively change state between a relatively low viscous state and a more rigid, or relatively high viscous state leading to an increased rigidity. Where the magnetorheological medium is a deformable solid, such as an elastomer or resin, it may be configured to selectively change state between a generally soft and elastic polymer or flexible film, and a more rigid, relatively stiff matrix.

A magnetorheological fluid (MRF) is generally a carrier fluid, such as an oil, that includes ferromagnetic particles randomly distributed therein in a functional suspension under normal circumstances. In one example, the ferromagnetic particles may be present as having a three dimensional shape, such as a sphere, ellipsoid, or the like. The ferromagnetic particles may have symmetrical as well as non-symmetrical or irregular shapes, and may also be present as rod-shaped or elongated particles. In aspects where the support substrate 66, 72 contains an MRF, it has the capability of changing one or more of its material properties, preferably viscosity (or the apparent viscosity), through the use of an external stimulant, preferably a magnetic field. For example, when a magnetic field is generated or otherwise applied, the ferromagnetic particles align themselves along the lines of the magnetic field, or magnetic flux.

Exemplary ferromagnetic particles include alloys of iron, nickel, and cobalt. Ceramics, such as sintered compositions of iron oxide and barium/strontium carbonate, as well as rare earth magnets, such as neodymium and samarium-cobalt, may also be useful with the present technology. The maximum possible magnetic field induced change in stress/modulus generally occurs when the aligned particles become magnetically saturated. While iron has been shown to have the highest saturation magnetization of elements, certain iron and cobalt alloys have even higher saturation magnetizations. Iron and cobalt alloys may also be preferred in certain aspects due to their high permeability and relatively low hysteresis loss.

Generally, the ferromagnetic particles may be randomly distributed within the support substrate 66, 72 when no magnetic field is applied. In the presence of a magnetic field of sufficient strength, however, the particles quickly acquire a magnetic polarization and will form chains of various strength, based in part on the strength of the magnetic field. It should also be understood that many of the specific features of the ferromagnetic particles such as their size/shape, distribution in the matrix, and percentage volume of the magnetic particles in the fluid or elastomer matrix can affect the overall behavior of the support substrate 66, 72.

In various aspects when using an MRF, it may be desired to control a buoyancy or relative density of the ferromagnetic particles to minimize particle settling and agglomeration. Thus, the ferromagnetic particles may be provided having different average sizes, weights, and content in order to provide a distribution of ferromagnetic particles with a range of densities to enhance dispersion. For example, certain of the ferromagnetic particles may be provided as solid particles, and other particles may be provided having a shell with a core. The core may be hollow or may be filled with a gas or other material in an effort to adjust density and buoyancy. Particles with different core sizes may be provided as appropriate for variations in density. Certain of the ferromagnetic particles may also be provided with an outer coating, for example, an outermost polymer coating such as silicone or the like. Preferably, a thickness of the polymer coating can be selected providing a sufficient buoyancy control to minimize settling of the particles, yet providing the same functionality to form a rigid shape support substrate 66, 72 upon being subjected to the magnetic field. In various aspects, the polymer coating itself may also be magnetically conductive. In still other aspects, the rate and degree to which settling and agglomeration occurs may be offset to a degree with the use of a surfactant additive. However, it should be understood that the addition of a surfactant may negatively affect the magnetic saturation of the fluid, which, in turn, may affect the maximum yield stress exhibited in the activated state, which is, in turn, related to the change in apparent viscosity of the support substrate 66, 72.

According to another alternative exemplary aspect of the present teachings, the support substrate 66, 72 can include one or more layer, or sheet. When present as a layer or sheet and provided as a solid or having a flexible matrix, the magnetorheological material may be present as a magnetorheological elastomer (MRE, otherwise known as a magnetosensitive elastomer), and/or include a magnetorheological foam (MR-foam). In certain instances, MREs with a porous matrix may also be referred to as foams or having a foamed matrix. Distinguished from an MRF, the presence of the layer of magnetorheological material as having a solid matrix base or a flexible matrix base (as an MRE or MR-foam) may minimize or otherwise avoid potential problems, such as particle settling of the ferromagnetic particles, as discussed above. It should be understood that an MRE can be provided in multiple layers. The layers may be adjacent one another, or separated as having an inner layer, an outer layer, and the like. Still further, an MRE may be provided in strips that may be aligned with one another or spaced apart having various designs and strengths. In this regard, it is envisioned that the strips and/or layers may be provided having different materials (elastomers and/or ferromagnetic particles), leading to different rigidity and the ability to customize the stiffness features. An MRE may also be presented with a weaved or shaped pattern or having various lattice structures.

MREs may include a class of elastomers that contain a polymeric matrix with embedded nano- to micro-sized ferromagnetic particles, such as carbonyl iron, arranged in a particular pattern. Common MREs may generally include a natural or synthetic rubber matrix that is then interspersed with the ferromagnetic particles. MR-foams generally provide an absorptive metal foam matrix in which a controllable fluid having the ferromagnetic particles is contained. Non-limiting exemplary metal foams may include aluminum, copper, and nickel.

Various different MREs can be prepared using a curing process. In one aspect, a liquid base polymer, such as silicone rubber, can be mixed with an iron powder, as well as other desired additives, and cured at a high temperature in the presence of a magnetic field. The presence of the magnetic field during the curing process is what causes a chain-like structural arrangement of the iron particles, which then results in an anisotropic material. Alternatively, it is envisioned that 3D printing techniques may also be used to configure the magnetic particles into a polymer matrix and shaped as a suitable support substrate 66, 72. The composite microstructure of an exemplary MRE is such that the mechanical properties of the material can thereafter be accurately controlled with the application of a magnetic field. In other words, if a magnetic field is not applied during the curing process, the resulting material will generally be considered an elastomer ferromagnet composite (EFC) that would essentially have little or no influence on the shape or stiffness. This is because the solid elastomer matrix of the EFC would prevent the ferromagnetic particles from forming chains, which is required for the change in apparent viscosity as described below.

Whether present as an MRF, MRE, MR-foam, or equivalent, upon selective activation of the support substrate 66, 72 using a controlled stimulus, i.e., the generation of one or more magnetic field(s), the ferromagnetic particles disposed therein are nearly instantaneously (within milliseconds in most occurrences) aligned into chains and/or particle clusters that are substantially parallel to the magnetic flux/field lines. Depending on the ferromagnetic materials and strength of the magnetic field that is generated, such chains may interconnect and form fibrils that may be branched from the chains. Clusters of these chains/fibrils exhibit a very high strength and, thus, increase the rigidity of the support substrate 66, 72, in certain aspects up to a maximum point such that the patient support 36 (or at least one region thereof) is functionally immobile, and will require a large amount of force in order to bend or flex. Subsequent deactivation, or removal of the magnetic field, will no longer maintain the clusters of chains/fibrils in an aligned orientation, allowing the support substrate 66, 72 to bend and flex again. It is envisioned that the activation and deactivation of the magnetic field can be repeated and performed any number of times, which permits ease of realignment and reuse of the patient support 36 with multiple patients of different size, shape, and with different medical needs.

In one non-limiting aspect of the present technology, the support substrates 66, 72, can include a distribution of ferromagnetic particles disposed in a flexible polymeric material. In various examples, polymeric materials useful as forming one of the support substrates 66, 72 may include low durometer thermoplastic elastomeric compounds and viscoelastomeric compounds that include an elastomeric block copolymer component and a plasticizer component. The plasticizer component can include various hydrocarbon molecules that associate with the material into which they are incorporated. The polymeric material can also include various additives in its formulation to obtain specific qualities.

The elastomer component of the example polymeric material may include a triblock polymer or copolymer of the general configuration A-B-A, wherein the "A" represents a crystalline polymer, such as a mono alkenylarene polymer, including but not limited to polystyrene and functionalized polystyrene, and the "B" represents an elastomeric polymer such as polyethylene, polybutylene, poly(ethylene/butylene), hydrogenated poly(isoprene), hydrogenated poly(butadiene), hydrogenated poly(isoprene+butadiene), poly(ethylene/propylene), hydrogenated poly(ethylene/butylene+ethylene/propylene), and the like. The "A" components of the polymeric material link to each other to provide strength, while the "B" components provide elasticity. Polymers of a greater molecular weight may be achieved by combining many of the "A" components in the "A" portions of each A-B-A structure, and combining many of the "B" components in the "B" portion of the A-B-A structure, along with the networking of the A-B-A molecules into large polymer networks.

The elastomeric "B" portion of the example A-B-A polymers generally has an exceptional affinity for most plasticizing agents, including but not limited to several types of oils, resins, and others. When the network of A-B-A molecules is denatured, plasticizers that have an affinity for the "B" block can readily associate with the "B" blocks. Upon renaturation of the network of A-B-A molecules, the plasticizer remains highly associated with the "B" portions, reducing or even eliminating plasticizer bleed from the material when compared with similar materials in the prior art, even at very high oil:elastomer ratios.

The elastomer used in the polymeric material may be an ultra-high molecular weight polystyrene-hydrogenated poly(isoprene+butadiene)-polystyrene, such as those sold under the brand names SEPTON 4045, SEPTON 4055 and SEPTON 4077 by Kuraray America, Inc., which has a place of business in Houston, Tex., an ultra-high molecular weight polystyrene-hydrogenated polyisoprene-polystyrene such as the elastomers made by Kuraray and sold as SEPTON 2005 and SEPTON 2006, or an ultra-high molecular weight polystyrene-hydrogenated polybutadiene-polystyrene, such as that sold as SEPTON 8006 by Kuraray. High to very high molecular weight polystyrene-hydrogenated poly(isoprene+butadiene)-polystyrene elastomers, such as that sold under the trade name SEPTON 4033 by Kuraray, may also be useful in some formulations of the example polymeric material because they may be easier to process than ultra-high molecular weight elastomers due to their effect on the melt viscosity of the material.

For examples of suitable elastomeric materials, the methods of making the same, and various suitable configurations for the support substrates 66, 72, reference is additionally made to U.S. Pat. Nos. 3,485,787; 3,676,387; 3,827,999; 4,259,540; 4,351,913; 4,369,284; 4,618,213; 5,262,468; 5,508,334; 5,239,723; 5,475,890; 5,334,646; 5,336,708; 4,432,607; 4,492,428; 4,497,538; 4,509,821; 4,709,982; 4,716,183; 4,798,853; 4,942,270; 5,149,736; 5,331,036; 5,881,409; 5,994,450; 5,749,111; 6,026,527; 6,197,099; 6,843,873; 6,865,759; 7,060,213; 6,413,458; 7,730,566; 7,823,233; 7,827,636; 7,823,234; and 7,964,664, which are all incorporated herein by reference in their entireties.

Other formulations of elastomeric materials may also be used in addition to those identified in these patents. As one example, the elastomeric material may be formulated with a weight ratio of oil to polymer of approximately 3.1 to 1. The polymer may be Kraton 1830 available from Kraton Polymers, which has a place of business in Houston. Tex., or it may be another suitable polymer. The oil may be mineral oil, or another suitable oil. One or more stabilizers or a dye may also be added, as well as other additional ingredients. In another example, the elastomeric material may be formulated with a weight ratio of oil to copolymers of approximately 2.6 to 1.

In one aspect, the support substrate 66, 72 can include a shape conforming medium such as a fluid or a deformable solid that may have a flexible matrix or some degree of flexibility that includes the ferro-magnetic particles. In certain aspects, ferro-magnetic particles can be coated with a compatible polymer that bonds with the Kraton styrene-butadiene-styrene blocks or to the cross-linked chains. Thus, when a current is applied, the chains shorten or become stiff, and changing the elastomeric properties. The particles can be suspended within the mineral oil, and then blended with the Kraton polymer during compounding.

With renewed reference to FIGS. 6-7, the polymeric material of the support substrate 66, 72 may be provided as a lattice structure including a plurality of cells 98 including the ferromagnetic particles in the cell walls. The cell walls may be considered as a plurality of upstanding side walls 102 that collectively define a repeating polygonal pattern.

As shown in FIG. 7, the lattice structure of the support substrate 66, 72 may include a number of wires 103 arranged in a predetermined pattern to form a conduit within the support substrate 66, 72. As shown, the wires 103 may be disposed at intersections of adjacent cells 98, and can collectively form a circuit configured to selectively generate a magnetic field. In other aspects, the wires 103 may be provided surrounding the sides of the cells 98 containing the magnetorheological medium. The wires 103 should be provided at an appropriate gauge thickness such that the passage of an appropriate amount of low voltage current through the wires will provide the necessary magnetic field required to activate the stiffening features of the support substrate 66, 72 to provide a desired rigidity. In certain aspects, the wires 103 may be provided wound in a coil shape, or the like, in order to generate a magnetic field.

Although shown running in the transverse direction, the wires 103 can additionally or alternatively be arranged in a longitudinal direction, or other desired pattern. In certain aspects, more than one wire 103 may be provided at the intersections. In still other aspects, wires 103 can be provided with a different or tapered gauge thickness, in order to provide a magnetic field of a different magnitude. In still further aspects, different gauge thicknesses and different magnetorheological materials can be used in combination to create different zones or areas that may provide different stiffness features once they are activated.

It is also envisioned that one or more electrical conduit can be provided as a separate component, independent from the support substrates. For example, an electrical conduit can be arranged and provided as a two-dimensional, or planar, configuration located adjacent, for example, underneath, the support substrate 66, 72. Such a planar configuration can also be designed with a pattern to provide certain areas with increased or decreased stiffness. In various aspects, the strength of the electrical current, as well as the pattern of the electrical current can be programmed, controlled, monitored, and modified using one or more controller 54.

Figure 8:
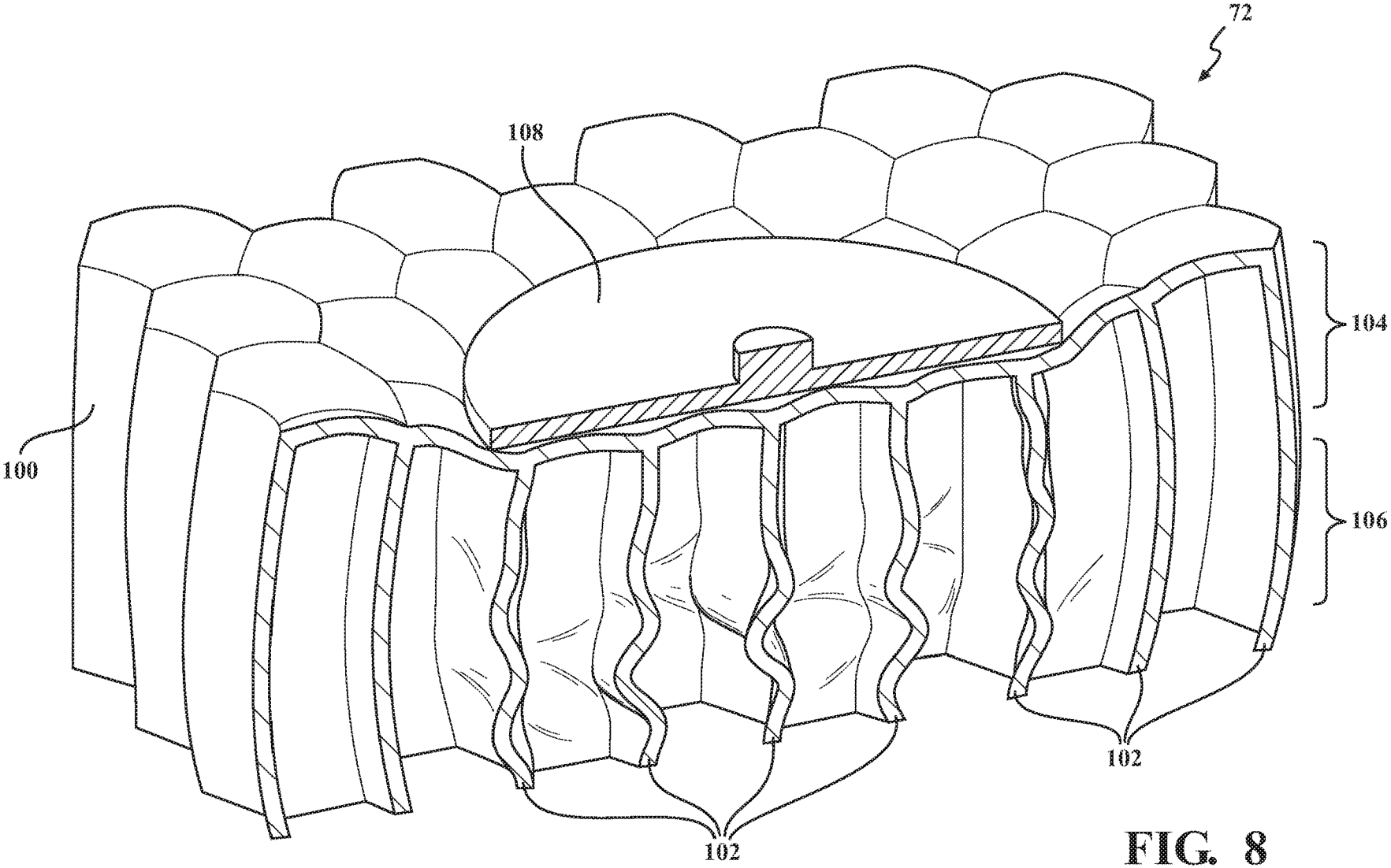
FIG. 8 is a cross-sectional view of a support substrate component subjected to pressure from a weight, illustrating a controlled buckling of cell walls of the support substrate component.

As shown in FIG. 7, the upstanding side walls 102, as well as the edges 100 of the support substrate may each be defined as having an upper portion 104 that may ultimately be adjacent a patient support surface 38, and a lower portion 106, generally opposite from the patient support surface. In various aspects, a thickness of the side wall of the upper portion 104 and a thickness of the lower portion 106 are different. In other aspects, the thickness of the upstanding side walls 102 may be tapered and slightly thinner at the lower portion 106. In still other aspects, the upper portion 104 and the lower portion 106 may include different magnetorheological materials, and/or contain a different amount of magnetorheological materials. In this regard, it may be feasible to design and obtain a different stiffness in different areas of the walls in order to provide a controlled buckling of the support substrate 66, 72. For example, FIG. 8 is a partial perspective cross-section view of a support substrate 72 component subjected to pressure from a circular shaped weight 108, illustrating a buckling of cell walls 102 of the support substrate 72. As shown, the lower portions 106 of the side walls collapse progressively up to the upper portions 104. This controlled buckling may help flatten the plateau that is found in the indentation force deflection (IFD) curves.

Figure 9:
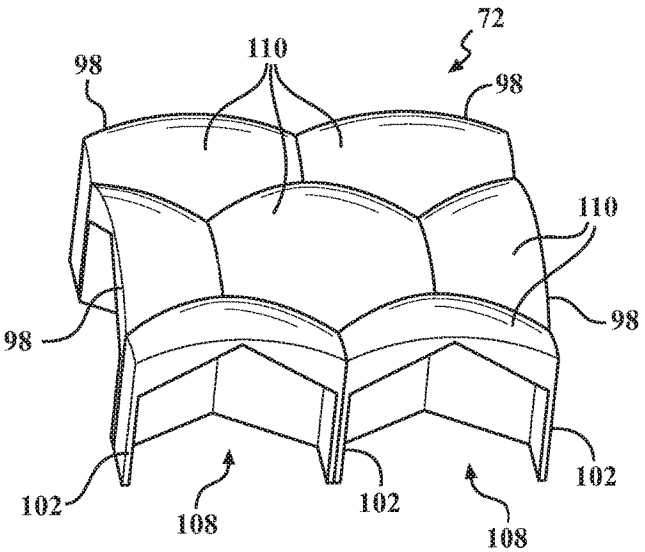
FIG. 9 is a magnified partial cross sectional view illustrating an interior region of an exemplary support substrate component with dome top cells according to various aspects of the present technology.

FIG. 9 is a magnified partial cross-sectional view illustrating an interior region 108 of hexagonal shaped cells 98 of an exemplary support substrate 72 component with each cell 98 having a dome top 110 according to various aspects of the present technology. In various aspects, the dome tops 110 may be formed as a single layer shaped and/or welded to the upstanding walls 102 of the cells 98. In various aspects, the dome tops 110 may include one or more magnetorheological material, for example, provided as one or more layer of a magnetorheological elastomer. In other aspects, the dome tops 110 may be individual components, for example, a separate piece formed with each cell 98 or subsequently attached thereto. In any configuration, the lattice of cells 98 can be designed/tuned with magnetorheological materials to provide an optimal buckling pressure, and the tops 110, or caps, can be designed/tuned with magnetorheological materials to assist in spreading out the tissue interface pressure (TIP) over a greater surface area.

Figure 10:
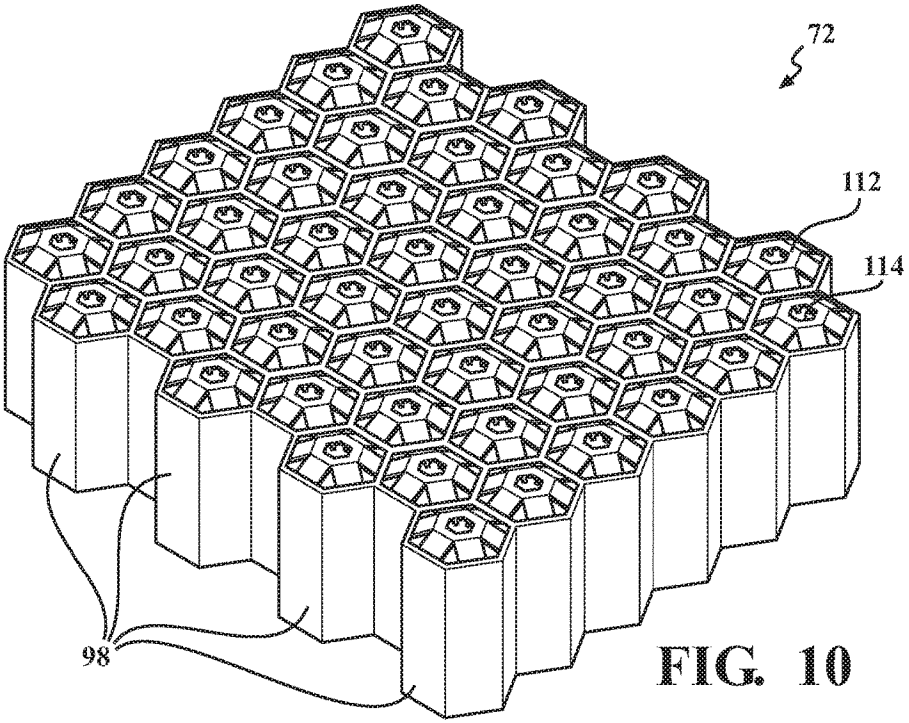
FIG. 10 is a side perspective view of a portion of a support substrate component with hexagonal shaped cells having shaped caps according to another aspect of the present technology.

FIG. 10 is a top-side perspective view of a portion of a support substrate component 72 with hexagonal shaped cells 98 and individual shaped tops 112 according to another aspect of the present technology. The tops 112 may be provided with an aperture 114 defined therein to provide fluid communication for air circulation between the cells 98 and the patient support surface 38. Similar to the dome tops 110 of FIG. 9, the tops 112 of FIG. 10 can also be designed/tuned with magnetorheological materials to assist in spreading out the TIP over a greater surface area.

Figure 11C:
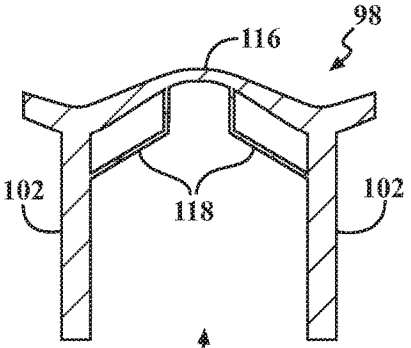
FIGS. 11A-11C are cross-sectional views of exemplary cells of a support substrate component provided with cells having a dome top (FIG. 11A), a dome top with a hole (FIG. 11B), and a buttressed dome top (FIG. 11C)
Figure 11B:
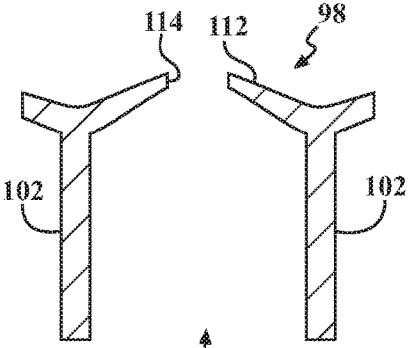
Figure 11A:
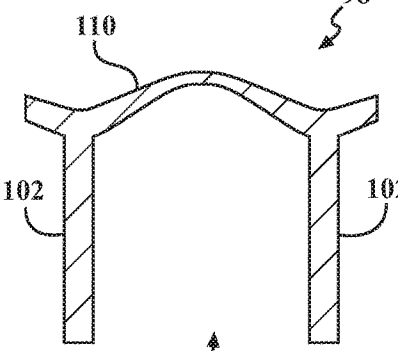

FIGS. 11A-11C are cross-sectional views of exemplary cells 98 of the support substrate component provided with a dome top 110 as shown in FIG. 9 (FIG. 11A), a dome top 112 with an aperture 114 as shown in FIG. 10 (FIG. 11B), and a buttressed dome top 116 with internal supporting features 118 (FIG. 11C). Similar to the dome tops 110, 112 of FIGS. 9 and 10, the buttressed top 116, and/or the supporting features 118, can also be designed/tuned with magnetorheological materials to assist in spreading out the TIP over a greater surface area.

Figure 12:
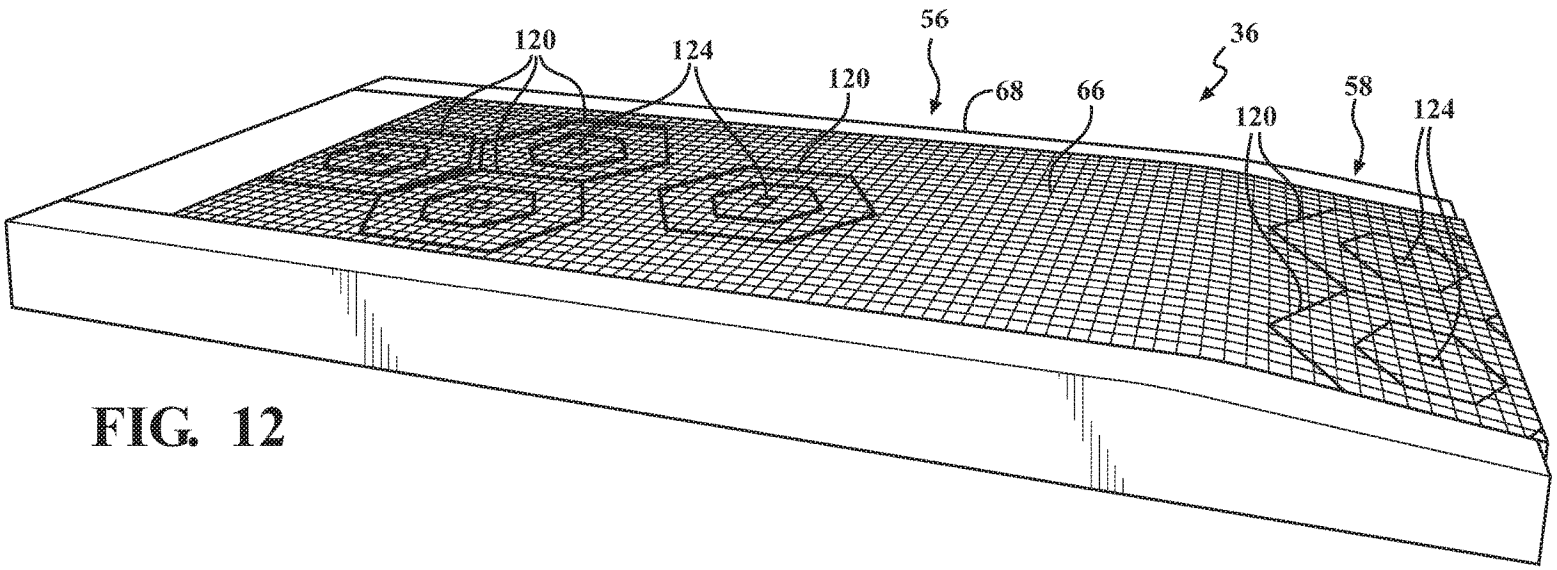
FIG. 12 is a top-side perspective view of the exemplary patient support of FIG. 2 with a plurality of separate zones configured to support different areas of a patient body.
Figure 13:
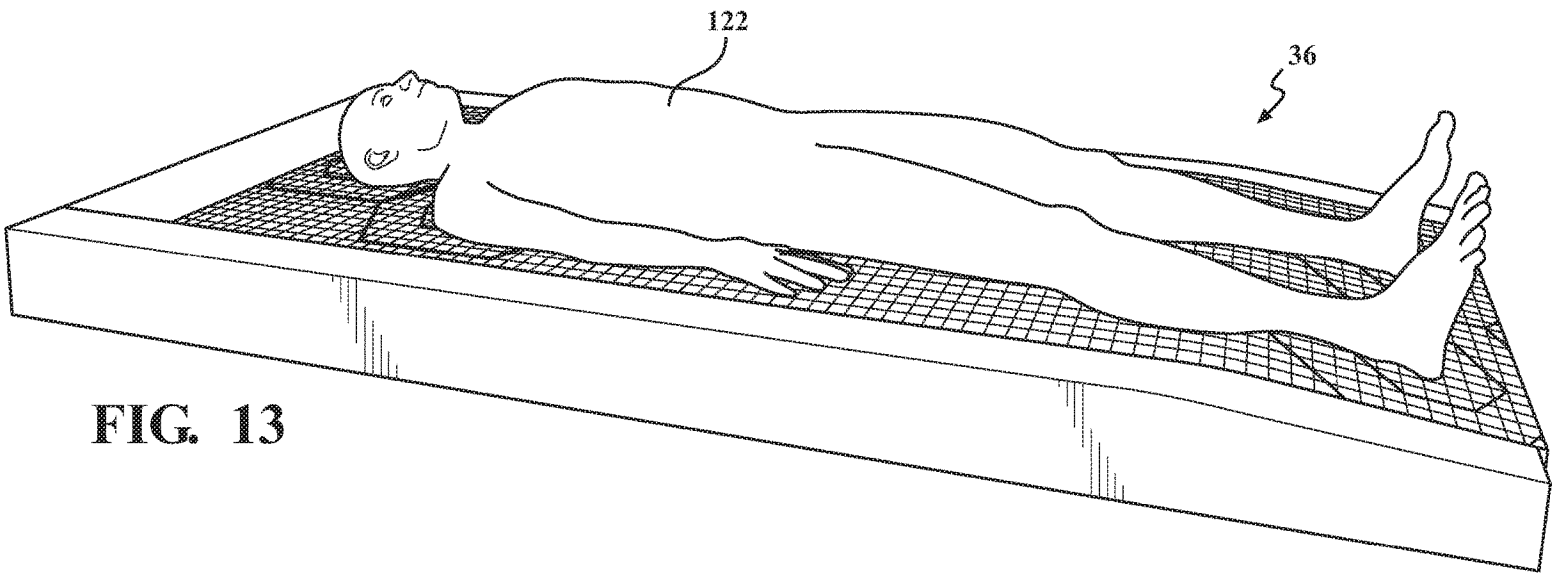
FIG. 13 is top-side perspective view of the exemplary patient support of FIG. 12 with a patient resting thereon.

FIG. 12 is a top-side perspective view of the exemplary patient support 36 of FIG. 2 with a plurality of separate zones, or regions 120, configured to support different areas of a patient body, and/or have a different stiffness. FIG. 13 is top-side perspective view of the exemplary patient support of FIG. 12 with a patient 122 resting thereon. By way of example, the patient support 36 may be appropriately segmented by regions 120 shaped and sized for different areas of the human body, such as for: upper/lower legs, knees, ankles, and/or feet; upper/lower arms, elbows, wrists, and/or hands; head, neck, and shoulders; upper and lower abdomen or torso; chest area; and combinations thereof. The regions 120 may further be designed to include inner region portions and outer region portions, such as concentric regions. Regions 120 can also vary in shape and size along a height direction. Different regions 120 may have different lattice structures or cell structures. Different regions can also include different magnetorheological materials, different electromagnets, use different amounts of applied current, be provided with different wiring architectures or circuit designs, and even be provided with the ability to be isolated from a magnetic field.

Common regions 120 may be separated into shoulder areas, hip areas, and leg areas. In certain aspects, the different regions 120 are static or permanent and do not change in size or location with respect to the specific patient support. In other aspects, the regions 120 may be designed with an architecture configured to change in size and/or location. For example, a caregiver or a user may be able to input certain information regarding a patient's age, weight, and height, and with the assistance with a pre-programmed controller using correlated data, the size and/or location of regions 120 may be configured based on patient-specific data. In this regard, for example, the same patient support can be used with a young teenager, as well as a full grown adult, and provide equal benefits to patients of varying size and shape.

Figure 14:
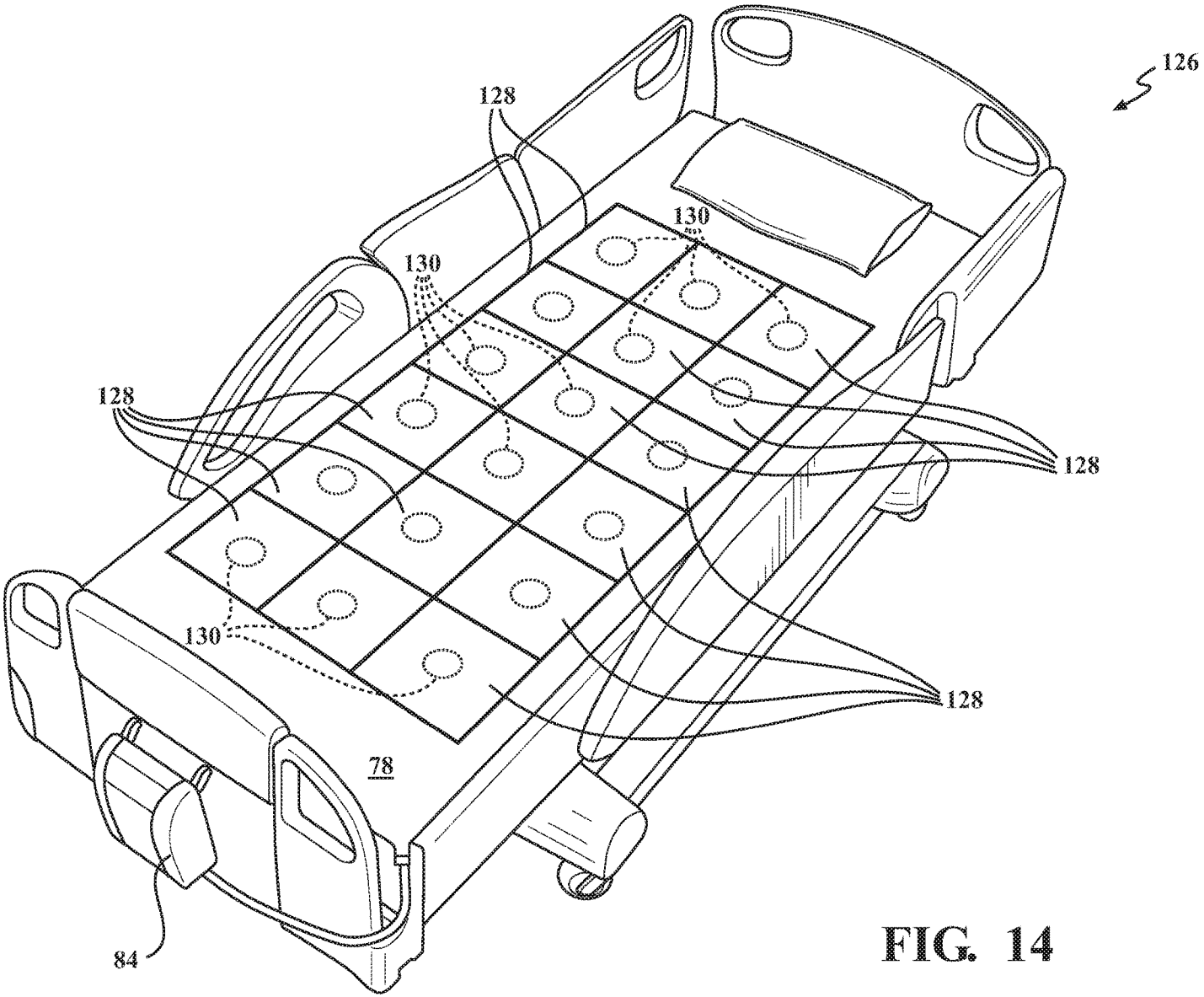
FIG. 14 is a top-side perspective view of an exemplary patient support apparatus shown with a plurality of separate zones that may be useful with the present technology.

FIG. 14 is a top-side perspective view of another exemplary patient support apparatus 126 shown with an alternate plurality of separate regions 128 that may be useful with the present technology. As mentioned above, the various regions 128 that may exhibit a different stiffness based on having different magnetic field strengths, or be provided with different magnetorheological materials. In various aspects, the regions 128 may be distinguished from one another as being different thermal zones, and/or different pressure zones. In certain aspects, different thermal zones can be managed by the air circulation device 84 and/or the controller 54. As mentioned above, FIG. 14 also illustrates an exemplary circulation device 84 that may be in fluid communication with a least a portion of the patient support 36 mattress. The heat transfer medium used in the circulation device 84 can be a heat transfer fluid or gas, such as air, configured to circulate or flow through at least a portion of the patient support apparatus at a predetermined or otherwise controlled temperature. In the various different aspects, the heat transfer medium serves to alter or maintain a temperature of a surface adjacent to, or an interface in direct contact with, the patient, such as the patient's skin.

In various aspects, the magnetic field can be generated either by an electromagnet or an electrically conductive circuit that is integrated with, or separate and distinct from, the patient support 36. In one example, with reference to FIG. 14, a patient support 36 may be provided with a plurality of electromagnets 130, each with a capability of generating a magnetic field configured to operate the stiffening features of the respective regions 128 of the patient support 36.

In another specific aspect, a bed component, such as a litter assembly or mattress pad (not shown) that defines a patient support surface 38 of a patient support 36 may be provided with a number of different segmented areas that may each contain an appropriately configured electromagnet (or electrically conductive circuit) strategically disposed therein and configured to generate a suitable magnetic field to work with the support substrates 66, 72.

As discussed above, one or more controller 54 (FIG. 1) may be provided to control and manage various aspects of the present technology. For example, the controller 54 may be programmed and configured to monitor and control the electrically conductive conduits 103 and/or electromagnets disposed within, or external from, the support substrate 66, 72, and ultimately provide the appropriate strength of a magnetic field to the magnetorheological material, resulting in a desired level of stiffness and rigidity of the patient support 36. The controller 54 may also be configured to work with a heat exchanger or the air circulation device 84, for example, to monitor and/or regulate the heating and cooling thermal management features of the present technology. In certain aspects, the controller 54 may be remotely monitored, operated, or programmed, via an appropriate wired or wireless connection, by a caregiver or medical professional. In certain aspects where the patient support 36 may be used outside of a medical or care facility, the controller 54 may be provided with a portable source of power, such as a battery. In still other aspects, a battery (or other source of electrical current) may be separately provided in order to generate the appropriate magnetic fields. The patient support apparatus 18, as well as the electromagnet or other source providing the magnetic field may also be managed by the controller 54. Alternatively, it is also envisioned that the controller 54 can be coupled to, or an integral part of, the patient support apparatus 18, as shown in FIG. 1.

In still other aspects, the support substrates 66, 72 may be used in combination with one or more shape-memory materials, such as a shape-memory polymer or a shape-memory alloy provided as part of the structure of the support substrate 66, 72. A shape-memory material may also be provided with other components of the patient support 36, for example, in conjunction with foam bolsters and other cushions or foam components. A shape-memory polymer is a polymer that has the ability to return from a temporary deformed state to its original state when induced by a stimulus, such as a change in temperature. A shape-memory alloy is preferably a lightweight alloy that similarly has the ability to return to its original shape after being deformed, for example, a deformed shape-memory alloy returns to its pre-deformed shape when heated. Non-limiting examples of shape-memory alloys useful with the present technology include copper-aluminum-nickel, and nickel-titanium alloys.

In various aspects, the patient support apparatus 18 may include at least one pressure sensor 124 (FIG. 12) strategically located within the patient support 36 and configured to detect a pressure at an interface between the patient support surface 38 and the patient. One or more pressure sensors can be located on a surface of the patient support 36, as well as disposed at strategic locations within the patient support 36. In this regard, the controller 54 may be configured to monitor a pressure between the various areas or surfaces of the patient support 36 and the patient. Various temperature sensors (not shown) may also be provided to monitor a temperature of the patient support 36, a temperature of air circulating within the patient support 36, as well as a temperature of the patient to ensure proper operation of the patient support apparatus 18 and the various components thereof. In various aspects, heat from the wires 103 or circuits can be used to provide integral thermal management. In still other aspects, the magnetorheological material is thermally conductive and can be used to adjust a temperature of the patient support.

The present technology also provides various methods of making a patient support apparatus capable of selectively adjusting a stiffness for redistributing pressure, and methods for adjusting a pressure distribution between a patient and a patient support apparatus. The methods for making the patient support apparatus include integrating a magnetorheological material within a component of the patient support apparatus. As described above, the patient support apparatus will include at least one component defining a patient support surface. At least a portion of the patient support surface will be configured to provide a selectively variable degree of rigidity against a predetermined location of a patient. The methods of making the apparatus include integrating at least one of an electrically conductive circuit and an electromagnet disposed adjacent the magnetorheological material in the patient support apparatus.

A controller may be used with the methods for adjusting a pressure distribution between a patient and a patient support apparatus, in particular, to selectively generate a magnetic field, which may be based on patient-specific data, or which may be pre-programmed for certain settings and situations. For example, correlations can be made between the applied current, patient support stiffness, and patient weight in order to provide an optimal pressure redistribution for a patient that can adjust in real time. In various aspects, the patient-specific data is entered by a caregiver, and the system or controller configures appropriate parameters and generates a magnetic field in order to adjust a stiffness of the patient support prior to the patient being placed on the patient support surface. Adjustments can be made at any time.

In various aspects, the patient-specific data typically includes the age, weight, and height of the patient. Other data useful for specifically tailoring the stiffness and pressure of the patient support may also include information about pre-existing wounds or pre-existing medical conditions or issues, such as the presence of one or more implant devices; the ability to move or use limbs; the use of prosthetic devices; mental status and cognitive ability; physical therapy requirements; movement restrictions; specific location of bony prominences and wounds; and the like. Pressure map data specific to the patient may also be useful in determining proper pressure redistribution, for example, based on a concentration of TIP. In various aspects, pressure map data can be separately obtained and provided to the system or controller. In other aspects, the patient support apparatus may be configured with the necessary components to obtain pressure map data.

The foregoing description is provided for purposes of illustration and description and is in no way intended to limit the disclosure, its application, or uses. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range, including the endpoints.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

What is claimed is:

1. A system for adjusting a stiffness of a patient support surface of a patient support apparatus, the system comprising:

a patient support apparatus comprising a support substrate and defining the patient support surface, wherein the support substrate includes a polymeric material defining a lattice structure with a plurality of polygonal cells, wherein the lattice structure comprises a plurality of upstanding side walls with each side wall having an upper portion adjacent the patient support surface and a lower portion;

a magnetorheological material disposed in at least a portion of the support substrate and providing selective reinforcement support of at least a portion of the patient support surface to redistribute pressure about a surface of a patient when a magnetic field is generated by selectively buckling the support substrate in a controlled manner; and a controller configured to selectively activate a generation of the magnetic field, wherein an upper portion of the side walls provides a first level of reinforcement support, and wherein a lower portion of the side walls provide a second level of reinforcement support that is less than the first level of reinforcement support, and wherein a relative amount of the magnetorheological material in the upper portion of the side walls is different than a relative amount of the magnetorheological material in the lower portion of the side walls or wherein the magnetorheological material in the upper portion of the side walls is different than the magnetorheological material in the lower portion of the side walls.

2. The system according to claim 1, wherein the magnetorheological material comprises a distribution of ferromagnetic particles disposed within a polymeric material and exhibits a shape conforming, variable stiffness in response to exposure to a magnetic field.

3. The system according to claim 1, wherein the magnetorheological material comprises at least one of a magnetorheological elastomer and a magnetorheological foam that exhibits an increased rigidity in response to exposure to a magnetic field.

4. The system according to claim 1, wherein the controller is configured to selectively generate a magnitude of the magnetic field based on at least one of patient weight and pressure map data.

5. The system according to claim 1, wherein the patient support surface comprises a plurality of regions, and the controller is configured to selectively generate a different magnitude of the magnetic field based on a location of each region.

6. The system according to claim 1, further comprising one of:

an electrically conductive circuit disposed adjacent the support substrate, selectively activated by the controller, and configured to generate the magnetic field; and an electromagnet disposed adjacent the support substrate, selectively activated by the controller, and configured to generate the magnetic field.

7. The system according to claim 1, wherein the plurality of upstanding side walls collectively define a repeating polygonal pattern, with each side wall having an upper portion adjacent the patient support surface and a lower portion.

8. The system according to claim 7, wherein the relative amount of the magnetorheological material in the upper portion of the side walls is different than the relative amount of the magnetorheological material in the lower portion of the side walls and wherein the magnetorheological material in the upper portion of the side walls is different than the magnetorheological material in the lower portion of the side walls.

9. The system according to claim 1, wherein the relative amount of the magnetorheological material in the upper portion of the side walls is different than the relative amount of the magnetorheological material in the lower portion of the side walls and wherein the magnetorheological material in the upper portion of the side walls is different than the magnetorheological material in the lower portion of the side walls.

10. The system according to claim 1, further comprising an electrically conductive circuit configured to selectively generate a magnetic field.

11. The system according to claim 1, further comprising at least one electromagnet configured to selectively generate a magnetic field.

12. The system according to claim 1, wherein the magnetorheological material is thermally conductive.

13. The system according to claim 1, wherein the magnetorheological material comprises at least one of a magnetorheological elastomer and a magnetorheological foam that exhibits an increased rigidity in response to exposure to a magnetic field.

14. The system according to claim 13, wherein the magnetorheological elastomer is provided as a layer throughout at least a portion of the support substrate.

* * * * *